US008978193B2

(12) United States Patent
Chen

(10) Patent No.: US 8,978,193 B2
(45) Date of Patent: Mar. 17, 2015

(54) SPIN MOP

(71) Applicant: Cheng Kai Chen, Pomona, CA (US)

(72) Inventor: Cheng Kai Chen, Pomona, CA (US)

( * ) Notice: Subject to any disclaimer, the term of this patent is extended or adjusted under 35 U.S.C. 154(b) by 87 days.

(21) Appl. No.: 13/955,202

(22) Filed: Jul. 31, 2013

(65) Prior Publication Data

US 2015/0033484 A1 Feb. 5, 2015

(51) Int. Cl.

| | |
|---|---|
| ***A47L 13/20*** | (2006.01) |
| ***A47L 13/58*** | (2006.01) |
| ***A47L 13/14*** | (2006.01) |
| ***A47L 13/42*** | (2006.01) |

(52) U.S. Cl.
CPC *A47L 13/14* (2013.01); *A47L 13/42* (2013.01)
USPC ..... 15/260; 15/119.1

(58) Field of Classification Search
USPC ..... 15/119.1, 120.1, 260
See application file for complete search history.

(56) References Cited

U.S. PATENT DOCUMENTS

| | | | | |
|---|---|---|---|---|
| 8,214,963 | B2 * | 7/2012 | Yu | 15/119.1 |
| 8,316,502 | B2 * | 11/2012 | Shao | 15/119.1 |
| 2012/0047675 | A1 * | 3/2012 | Chu | 15/260 |
| 2012/0233803 | A1 * | 9/2012 | Chiang | 15/260 |
| 2013/0036563 | A1 * | 2/2013 | Lin | 15/119.1 |

* cited by examiner

*Primary Examiner* — Randall Chin
(74) *Attorney, Agent, or Firm* — Clement Cheng

(57) ABSTRACT

A spin mop includes a grip body casing. The grip body casing is an elongated member and hollow with an inside surface. The inside surface has a threaded panel assembly. The threaded panel assembly is formed in elongated shape and has threaded panel threads alternating with threaded panel fillets. A clutch shaft extends into the grip body casing. The clutch shaft is telescopically mounted to the grip body casing. A clutch assembly is formed on the clutch shaft. The clutch assembly extends into the grip body casing. The clutch assembly further includes a first clutch member and a second clutch member. The first clutch member is rotably mounted to the clutch shaft. The second clutch member is fixed to the clutch shaft. A helical tooth is formed on an external surface of the first clutch member.

18 Claims, 5 Drawing Sheets

SPIN MOP

FIELD OF THE INVENTION

The present invention is in the field of spin mops.

DISCUSSION OF RELATED ART

Traditional mops also have a wide variety of different designs for pressing out water. Unfortunately, traditional mops are difficult to use and are not as ergonomic since they require greater strength to operate.

As a result, a variety of different spin mops have rotational mechanisms for wringing out water using the force of the rotation. Typically, the head of the mop can spin to a fast enough rotation to allow water removal. A popular spin mop has a step lever that rotates a basket which in turn rotates a mop head. An example of this mop dehydrating device is Hsiao-Hung Chiang's patent number US 2012/0233803. The invention prescribes the use of a bucket, with a step lever ability to wring out any mop that fits within the interior rack. An improvement from the previous idea is Shu-Hsun Chu's dual-purpose spin dry mop, patented number US2012/0047675 and published on Mar. 1, 2012. A user would not only be able to dry the mop head, but an agitator exists next to the drying mechanism, which enables the separation of any debris attached to the mop head.

A new spin mop was described in United States patent 8,316,502 entitled Spin Dry Mop to inventor Guofa Shao issued Nov. 27, 2012, the disclosure of which is incorporated herein by reference. A feature of Shao's mop is its ability to spin-dry a mop head using an internal spiral drive mechanism, unlike the previously listed inventions that contained an external drying mechanism, the step lever switch.

SUMMARY OF THE INVENTION

The present invention has a screw drive mechanism to translate reciprocating linear motion into rotation of the mop head for wringing out water force.

A spin mop includes a grip body casing. The grip body casing is an elongated member and hollow with an inside surface. The inside surface has a threaded panel assembly. The threaded panel assembly is formed in elongated shape and has threaded panel threads alternating with threaded panel fillets. A clutch shaft extends into the grip body casing. The clutch shaft is telescopically mounted to the grip body casing. A clutch assembly is formed on the clutch shaft.

The clutch assembly extends into the grip body casing. The clutch assembly further includes a first clutch member and a second clutch member. The first clutch member is rotably mounted to the clutch shaft. The second clutch member is fixed to the clutch shaft. A helical tooth is formed on an external surface of the first clutch member.

The helical tooth is configured to engage with the threaded panel threads to impart a rotational motion to the first clutch member when the first clutch member translates up or down inside the threaded panel assembly. A clutch connection is preferably formed between the first clutch member and the second clutch member. Optionally, the clutch connection engages the first clutch member to the second clutch member when the grip body casing is pushed downward toward the clutch shaft. Additionally, a clutch disengagement spring is biasing the first clutch member away from the second clutch member when the grip body casing is pulled away from the clutch shaft. A mop head can be attached to a lower end of the clutch shaft. During usage, a user pushing the grip body casing toward the clutch shaft engages the clutch to spin the mop, and a user pulling the grip body casing away from the clutch shaft disengages the clutch.

The clutch connection includes a clutch member tooth lodging within a clutch member notch. A clutch disengagement spring chamber formed within the first clutch member. The clutch disengagement spring is mounted within the clutch disengagement spring chamber. The clutch shaft and the grip body casing are coaxial. A plastic washer can be mounted to a top portion of the first clutch member. A plastic washer is optionally mounted to a top portion of the first clutch member, and the plastic washer is preferably aligned to abut a suspension bumper that is housed within a suspension housing. Also, the suspension bumper can be formed as a coil spring. The clutch shaft has an extension member for extending a length of the clutch shaft. The first clutch member has a first clutch member smooth portion above the helical tooth. The threaded panel assembly is formed of a plurality of threaded panels inserted into threaded panel slots formed on an inside surface of the grip body casing. The first clutch member is an upper clutch member, and wherein the second clutch member is a lower clutch member, wherein the upper clutch member is mounted above the lower clutch member.

It is an object of the invention to improve the design of the spin mop.

The following call out list of elements can be a useful guide in referencing the elements of the drawings.

21 Threaded Panel Retainer Housing
22 Threaded Panel Retainer
31 Threaded Panel
32 Threaded Panel Tip
33 Threaded Panel Thread
34 Threaded Panel Fillet
41 Grip Body Casing
42 Threaded Panel Slot Ridge
43 Grip Body Casing Lower Thread Connection
44 Grip Body Casing Lower Nut Adjustment
45 Grip Body Casing Lower Connection Flange
46 Raised Grip Detail
47 Threaded Panel Slot
51 Clutch Shaft
52 Upper Clutch Member
53 Lower Clutch Member
54 Upper Clutch Washer
55 Upper Clutch Member Smooth Portion
56 Upper Clutch Member Tooth
57 Lower Clutch Member Notch
61 Lower Extension Rod
71 Circular Mop Head
72 Mop Angle Axle
73 Lower Extension Rod Socket
81 Helical Tooth
82 Helical Tooth Fillet Edge
83 Helical Fillet
101 Grip

102 Casing
103 Screw Layer
104 Upper Engaging Nut
105 Coupling Sleeve
106 Lower Engaging Nut
107 Suspension Housing
108 Suspension Bumper
109 Plastic Washer
110 First Clutch Member
111 Clutch Disengagement Spring Chamber
112 Clutch Disengagement Spring
113 Second Clutch Member
114 Extension Area
115 Bolt Connector
117 Extension Rod
118 Locking Seat
119 Horizontal Axle
120 Turn Socket
121 Spacer
122 Circular Disc
123 Mop Fibers

DETAILED DESCRIPTION OF THE PREFERRED EMBODIMENT

Figure 1:
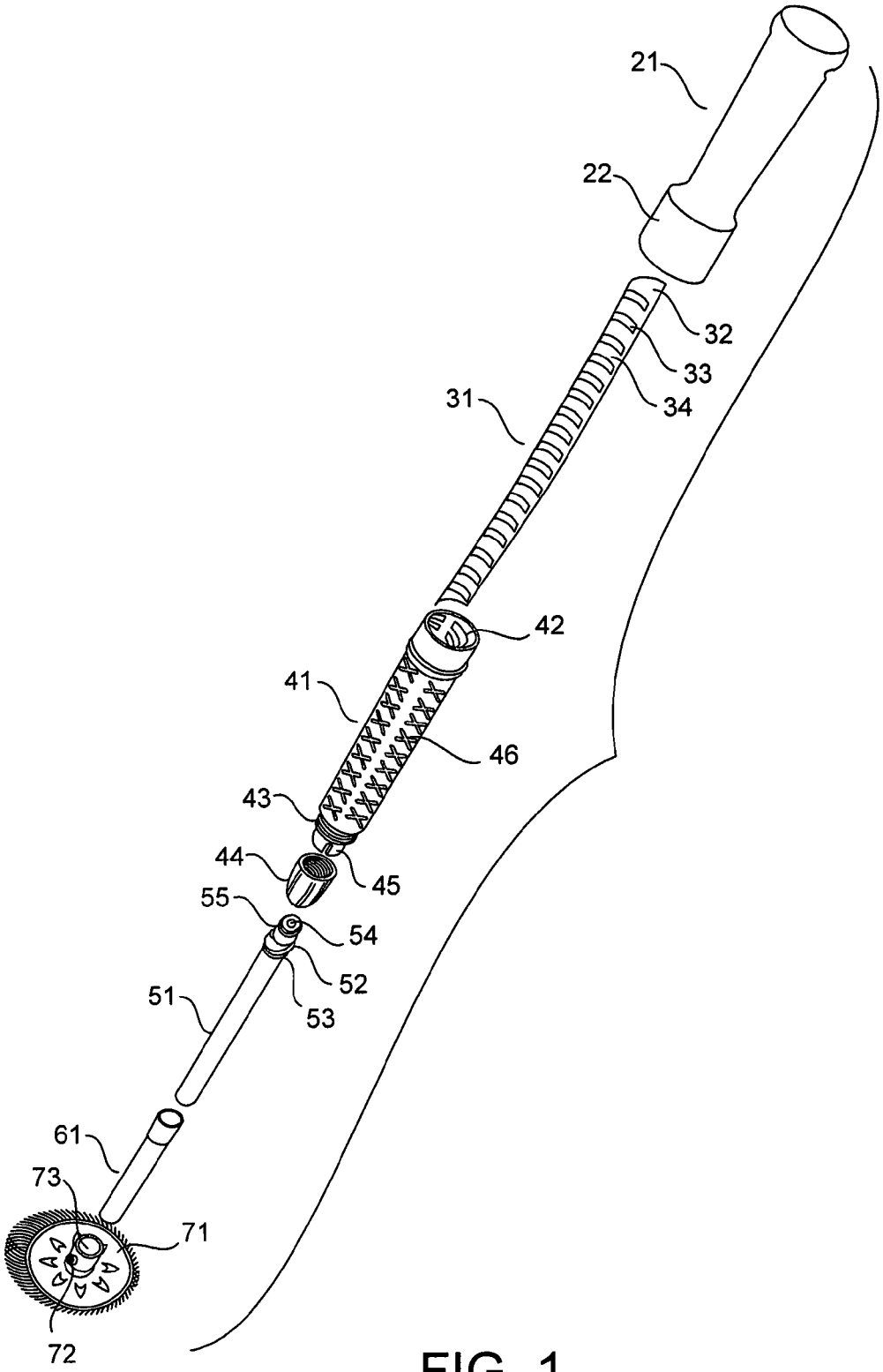
FIG. 1 is an exploded view of the present invention before assembly.

FIG. 1 shows an exploded view of the present invention including a threaded panel retainer housing 21 being formed as the grip 101 of the mop. The grip is a top handle and formed also as a cap covering the threaded panel assembly of the present invention. The cap can be formed as a threaded panel retainer 22 formed on the lower portion of the threaded panel retainer housing 21. The threaded panel retainer 22 pushes down on the threaded panel tip 32 to retain the threaded panel 31 inside the grip body casing 41 when the threaded panel 31 is slidingly installed into the grip body casing 41.

The threaded panel thread 33 is formed on the threaded panel 31. The threaded panel thread 33 is formed as sections of a helical coil of thread. The threaded panel thread 33 is shaped like rectangles or trapezoids to form a helical guide. The threaded panel thread 33 has threaded panel fillets 34 between the threaded panel thread 33. The threaded panel thread 33 protrudes at regular intervals from a concave surface. The threaded panel 31 is preferably made to be symmetrical or the same mold as the other threaded panels 31. A pair of threaded panels, or three or four or five or more threaded panels can be spaced at equal angles from each other.

The threaded panel 31 is installed into the grip body casing 41 between threaded panel slot ridges 42. The grip body casing lower thread connection 43 is formed on the grip body casing 41 and the grip body casing lower connection flange 45 extends from the body casing lower thread connection 43. A grip body casing lower nut adjustment 44 fits over the grip body casing lower connection flange 45 and screws onto the grip body casing lower thread connection 43. A user can tighten or loosen the grip body casing lower nut adjustment 44 to close or enlarge the grip body casing lower connection flange opening. The opening of the lower connection flange grips around the clutch shaft. The variable grip can be made loose or tight. The connection is loose when a user needs to rotate the mop for wringing, and the connection is made tight when the user is using the mop for cleaning.

Figure 2:
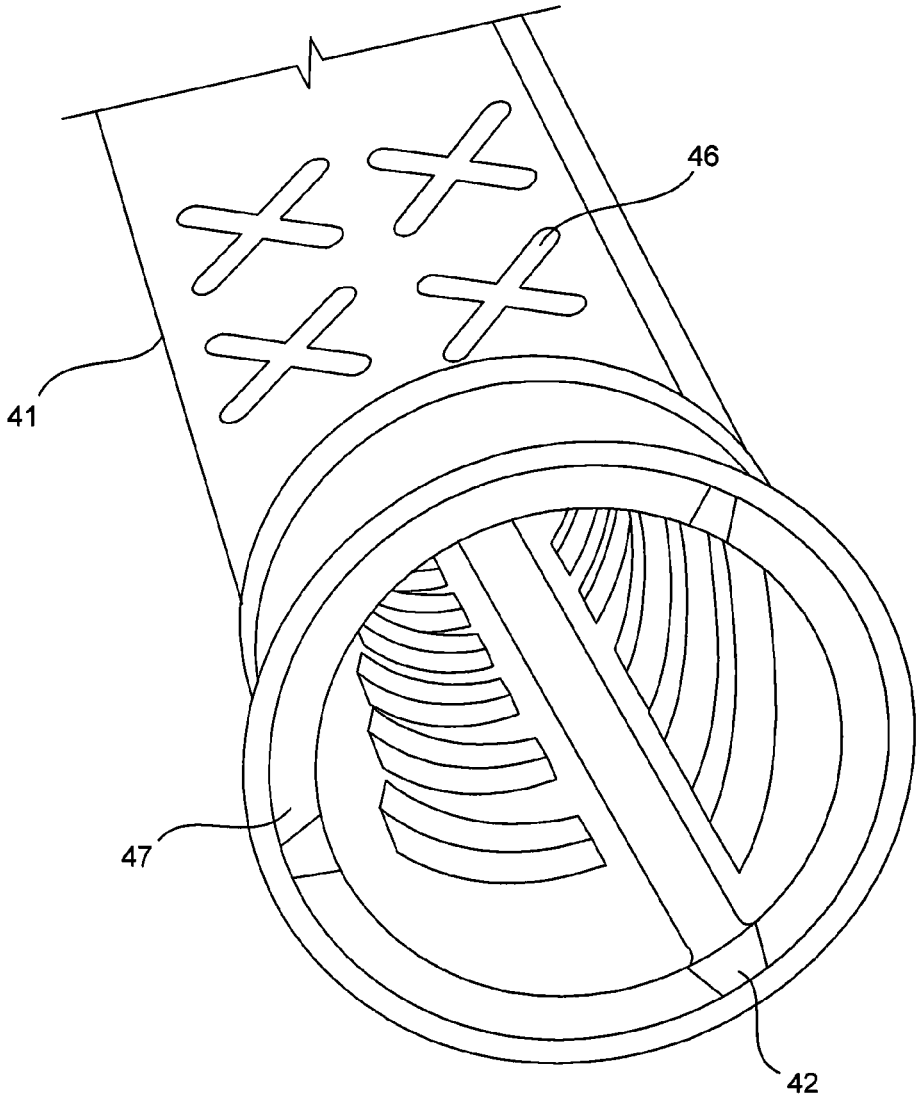
FIG. 2 is a close-up view of the threaded panel retainer opening.

As seen in FIG. 2, three threaded panel slots 47 are bounded by threaded panel slot ridges 42. The threaded panel slots 47 have a trapezoid profile to retain edges of the threaded panels. The threaded panels are inserted into the threaded panel slots. The outside of the grip body casing 41 also has raised grip detail 46 shown in FIG. 1 as hatch marks.

The clutch assembly is mounted on the clutch shaft 51 at either the top end or the bottom end of the clutch shaft 51. The clutch includes an upper clutch member 52 over a lower clutch member 53. The upper clutch member engages with the lower clutch member when the upper clutch member is pushed down onto the lower clutch member. The upper clutch member has an upper clutch washer 54 mounted over the upper clutch member 52.

Figure 3:
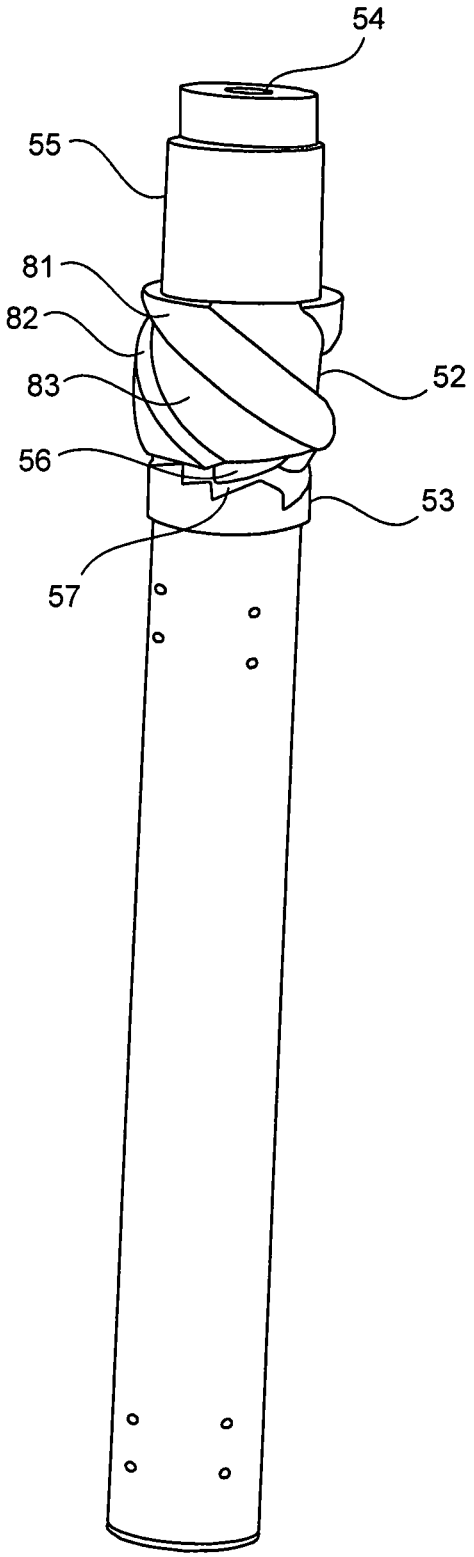
FIG. 3 is a side view of the clutch mechanism.

As seen in FIG. 3, the clutch can be formed as an upper clutch member 52 mounted over a lower clutch member 53. The upper clutch member 52 rotates about a center axis of rotation, but the lower clutch member 53 is rigidly attached to the clutch shaft 51 below. The clutch shaft may have crimped connection to the lower clutch member 53. The crimped connection can be shown as dots that are depressions on the clutch shaft. The upper clutch member 52 preferably has a plurality of upper clutch member teeth 56 that engage into lower clutch member notches 57 when the upper clutch member is pushed down to engage with the lower clutch member. The upper clutch member is biased away from the lower clutch member by a spring that is preferably held within the upper clutch member.

When the clutch shaft 51 is being pulled away from the grip body casing 41, the coil spring within the upper clutch member 52 pushes the upper clutch member 52 away from the lower clutch member 53. The threaded panel thread 33 engages with the upper clutch member when the clutch shaft 51 telescopes with grip body casing 41. Grip body casing 41 is external to the clutch shaft 51. The clutch shaft 51 passes into the grip body casing 41. The clutch shaft 51 also passes between the threaded panels 31. As the clutch on the clutch shaft 51 passes between the threaded panels 31, the upper clutch member 52 rotates relative to the lower clutch member, because the upper clutch member is not engaged to the lower clutch member. The disengaged position is further supported by the threaded panel thread 33 pushing up on a lower surface of a helical tooth 81. The helical tooth 81 is formed on the upper clutch member 52. The helical tooth 81 has a helical tooth fillet edge 82 and an upper edge and on a lower edge as well. The helical tooth fillet upper edge is shown in FIG. 3. The helical tooth fillet lower edge engages with the threaded panel thread when the clutch shaft 51 is being pulled away from the grip body casing 41. Because the clutch is disengaged during pulling motion, the mop does not spin.

The mop spins when the clutch is in an engaged position which is when the clutch shaft 51 is being pushed toward the grip body casing 41, or when the grip body casing is being pushed toward the clutch shaft 51. The clutch has an engaged position which is an opposite position of its disengaged position. The engaged position occurs when the grip body casing 41 is pushed toward the clutch shaft 51. The upper clutch member helical tooth fillet edge 82 is pushed down against the spring bias so that the upper clutch member upper clutch member tooth 56 is engaged into the lower clutch member notch 57. The shape of the upper clutch member tooth 56 is conformed to the shape of the lower clutch member notch 57. Both the upper clutch member tooth 56 and the lower clutch member notch 57 have a jagged surface with at least one point and an incline. The incline allows the rotation in one direction only. In engaged position, the mop spins when the user grips the grip body casing 41 and pushes downward. A user can put the mop head on a rotary basket that rotates when a user pushes down on the spin mop grip body casing 41. The mop head could also have a protrusion that allows it to spin when in contact to a flat surface.

The clutch shaft 51 can be made longer by attaching it to a lower extension rod 61. The lower extension rod is in turn connected to a secular mop head 71. The mop has a mop angle axle 72 about which the head of the mop can adjust for different slopes of flooring. Preferably, the mop does not rotate about the mop angle axle 72 during wringing and the mop angle axle 72 is set to a 90° orientation during wringing. A user grabs the grip body casing and pushes down to spin the mop and wring the mop fibers 123.

Figure 4:
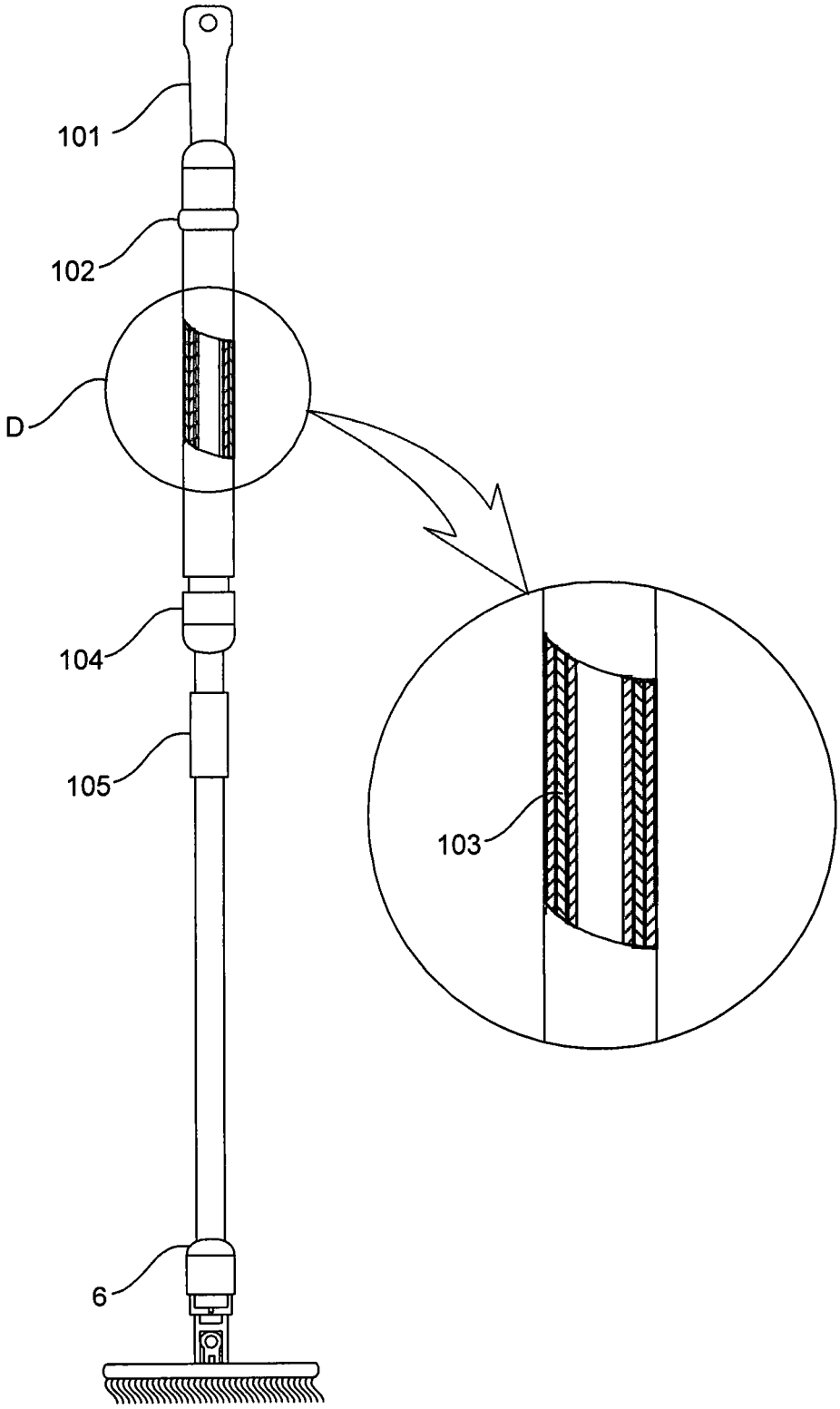
FIG. 4 is a general diagrammatic overview of the threaded panel.

As seen in FIG. 4, the threaded panel retainer housing 21 preferably has a grip 101 formed on the external portion of the threaded panel retainer housing 21. The grip body casing 41 is one type of casing 102 that can be implemented. The screw layer 103 is preferably formed as a plurality of threaded panels. The screw layer 103 is preferably sandwiched between the casing 102 to the outside of the screw layer 103 and the clutch shaft 51 to the inside of the screw layer 103. The screw layer 103 is retained within the casing 102. The upper engaging nut 104 controls the degree of friction between the rotation of the casing 102 and the clutch shaft 51. The upper engaging nut 104 is preferably formed as a grip body casing lower nut adjustment 44. The coupling sleeve 105 can be used for connecting the clutch shaft 51 to the lower extension rod 61.

The coupling sleeve 105 can be formed as a plastic sleeve that fits over hollow tubular steel members. The lower engaging nut 106 allows the mop head to be removed from the lower extension rod 61.

Figure 5:
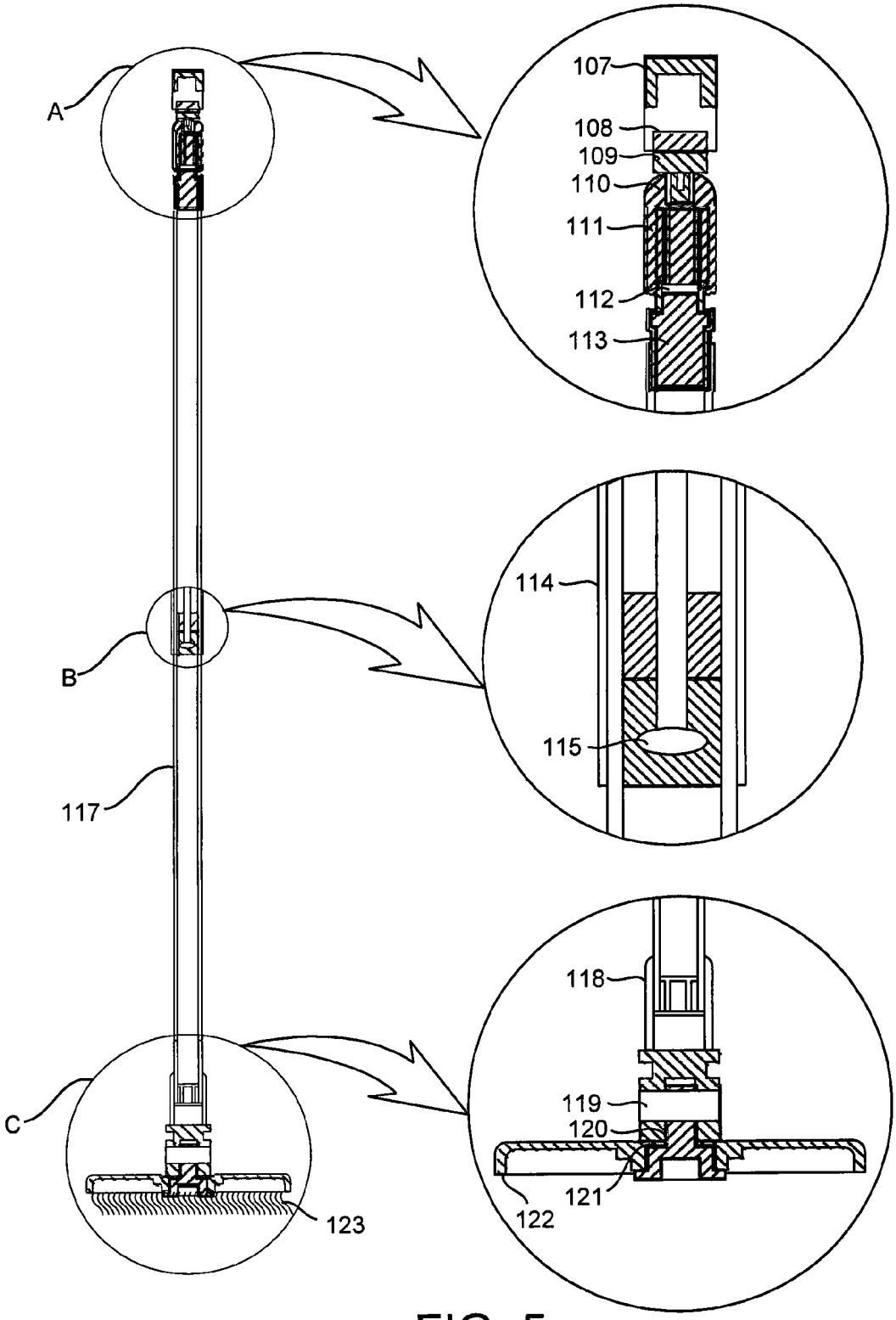
FIG. 5 is a general diagram of connection areas of the present invention.

As seen in FIG. 5, the grip 101 preferably includes a suspension housing 107. The suspension housing 107 holds a suspension bumper 108. The suspension bumper 108 attenuates shock from the motion of the clutch shaft 51. The upper clutch washer 54 may abut the suspension bumper 108. The suspension bumper 108 can be formed as a coil spring. The coil spring of the suspension bumper is preferably lodged within a cavity of the suspension housing 107 and can be connected by interference fit where an end of the coil spring is jammed into a cavity of the suspension housing. The suspension housing is formed within the grip 101. The upper clutch washer 54 is preferably formed as a plastic washer 109.

The spring is preferably a coil spring that is formed as a clutch disengagement spring 112. The clutch disengagement spring 112 separates and disengages the first clutch member 110 from the second clutch member 113. The first clutch member 110 preferably has a clutch disengagement spring chamber 111 that houses the clutch disengagement spring 112. The clutch disengagement spring 112 floats within the clutch disengagement spring chamber 111. An extension area 114 allows connection between the extension rod 117 from the clutch shaft 51. The extension rod 117 may have a bolt connector 115 that is lodged within an upper end of the extension rod 117.

The bolt connector 115 has a bolt that may engage with a threaded portion of the extension area 114 that is preferably found on the lower end of the clutch shaft 51.

Preferably, the extension rod 117 can be received in a locking seat 118 that receives the lower end of the extension rod 117. The locking seat is preferably mounted to a horizontal axle 119 that can be formed as a mop angle axle 72. The turn socket 120 allows rotation of the mop head to make mopping easier. The spacer 121 may allow better rotation during mopping. The mop head is preferably formed as a circular disc 122 carries a replaceable mop fiber cartridge that has a plurality of mop fibers 123 for cleaning.

The above detailed description of the preferred embodiment is an example of an apparatus described by the following claims.

The invention claimed is:

1. A spin mop comprising:

a. a grip body casing, wherein the grip body casing is an elongated member and hollow with an inside surface, wherein the inside surface has a threaded panel assembly, wherein the threaded panel assembly is formed in elongated shape and has threaded panel threads alternating with threaded panel fillets;

b. a clutch shaft extending into the grip body casing, wherein the clutch shaft is telescopically mounted to the grip body casing;

c. a clutch assembly formed on the clutch shaft, wherein the clutch assembly extends into the grip body casing, wherein the clutch assembly further comprises a first clutch member and a second clutch member, wherein the first clutch member is rotably mounted to the clutch shaft, wherein the second clutch member is fixed to the clutch shaft;

d. a helical tooth formed on an external surface of the first clutch member, wherein the helical tooth is configured to engage with the threaded panel threads to impart a rotational motion to the first clutch member when the first clutch member translates up or down inside the threaded panel assembly;

e. a clutch connection between the first clutch member and the second clutch member, wherein the clutch connection engages the first clutch member to the second clutch member when the grip body casing is pushed downward toward the clutch shaft;

f. a clutch disengagement spring biasing the first clutch member away from the second clutch member when the grip body casing is pulled away from the clutch shaft; and g. a mop head attached to a lower end of the clutch shaft, whereby a user pushing the grip body casing toward the clutch shaft engages the clutch to spin the mop, and whereby a user pulling the grip body casing away from the clutch shaft disengages the clutch.

2. The spin mop of claim 1, wherein the clutch connection includes a clutch member tooth lodging within a clutch member notch.

3. The spin mop of claim 1, further comprising a clutch disengagement spring chamber formed within the first clutch member, wherein the clutch disengagement spring is mounted within the clutch disengagement spring chamber.

4. The spin mop of claim 1, wherein the clutch shaft and the grip body casing are coaxial.

5. The spin mop of claim 1, further comprising a plastic washer mounted to a top portion of the first clutch member.

6. The spin mop of claim 1, wherein a plastic washer is mounted to a top portion of the first clutch member, wherein the plastic washer is aligned to abut a suspension bumper that is housed within a suspension housing, wherein the suspension bumper is formed as a coil spring.

7. The spin mop of claim 1, wherein the clutch shaft has an extension member for extending a length of the clutch shaft.

8. The spin mop of claim 1, wherein the first clutch member has a first clutch member smooth portion above the helical tooth.

9. The spin mop of claim 1, wherein the threaded panel assembly is formed of a plurality of threaded panels inserted into threaded panel slots formed on an inside surface of the grip body casing.

10. The spin mop of claim 1, wherein the first clutch member is an upper clutch member, and wherein the second clutch member is a lower clutch member, wherein the upper clutch member is mounted above the lower clutch member.

11. The spin mop of claim 10, wherein the clutch connection includes a clutch member tooth lodging within a clutch member notch.

12. The spin mop of claim 10, further comprising a clutch disengagement spring chamber formed within the first clutch member, wherein the clutch disengagement spring is mounted within the clutch disengagement spring chamber.

13. The spin mop of claim 10, wherein the clutch shaft and the grip body casing are coaxial.

14. The spin mop of claim 10, further comprising a plastic washer mounted to a top portion of the first clutch member.

15. The spin mop of claim 10, wherein a plastic washer is mounted to a top portion of the first clutch member, wherein the plastic washer is aligned to abut a suspension bumper that is housed within a suspension housing, wherein the suspension bumper is formed as a coil spring.

16. The spin mop of claim 10, wherein the clutch shaft has an extension member for extending a length of the clutch shaft.

17. The spin mop of claim 10, wherein the first clutch member has a first clutch member smooth portion above the helical tooth.

18. The spin mop of claim 10, wherein the threaded panel assembly is formed of a plurality of threaded panels inserted into threaded panel slots formed on an inside surface of the grip body casing.

* * * * *